US006954608B2

(12) United States Patent
Sekiguchi et al.

(10) Patent No.: US 6,954,608 B2
(45) Date of Patent: Oct. 11, 2005

(54) HEATING DEVICE AND IMAGE FORMING APPARATUS

(75) Inventors: Hajime Sekiguchi, Kashiwa (JP); Atsushi Fuseya, Tsuchiura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/270,140

(22) Filed: Oct. 15, 2002

(65) Prior Publication Data

US 2003/0086736 A1 May 8, 2003

(30) Foreign Application Priority Data

Oct. 15, 2001 (JP) ..... 2001-317261

(51) Int. Cl.[7] ..... G03G 15/20

(52) U.S. Cl. ..... 399/334; 219/216; 219/619; 399/69; 399/328

(58) Field of Search ..... 399/334, 330, 399/328, 329, 320, 45, 67, 69; 219/216, 619, 671, 469

(56) References Cited

U.S. PATENT DOCUMENTS

| | | | | | |
|---|---|---|---|---|---|
| 4,585,325 | A | * | 4/1986 | Euler | 399/69 |
| 5,083,168 | A | | 1/1992 | Kusaka et al. | 399/329 |
| 5,148,226 | A | | 9/1992 | Setoriyama et al. | 399/329 |
| 5,210,579 | A | | 5/1993 | Setoriyama et al. | 399/338 |
| 5,525,775 | A | | 6/1996 | Setoriyama et al. | 219/216 |
| 5,552,582 | A | | 9/1996 | Abe et al. | 219/619 |
| 5,767,484 | A | | 6/1998 | Hirabayashi et al. | 219/216 |
| 5,822,669 | A | * | 10/1998 | Okabayashi et al. | 399/330 |
| 6,078,781 | A | | 6/2000 | Takagi et al. | 399/330 |
| 6,373,036 | B2 | * | 4/2002 | Suzuki | 219/619 |
| 6,463,252 | B2 | * | 10/2002 | Omoto et al. | 399/330 |
| 6,492,630 | B2 | * | 12/2002 | Nagahira | 219/619 |
| 6,560,421 | B1 | * | 5/2003 | Matsumoto | 399/69 |
| 2003/0077093 | A1 | * | 4/2003 | Sekiguchi | 399/328 |

FOREIGN PATENT DOCUMENTS

| | | | |
|---|---|---|---|
| JP | 63-313182 | | 12/1988 |
| JP | 2-157878 | | 6/1990 |
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 4-166966 | | 6/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 5-9027 | | 2/1993 |
| JP | 8-16005 | | 1/1996 |
| JP | 9-171889 | | 6/1997 |
| JP | 10-74099 | | 3/1998 |
| JP | 11-109774 | | 4/1999 |
| JP | 11-202652 | | 7/1999 |
| JP | 2002-162913 | | 6/2000 |
| JP | 2002-221863 | * | 8/2002 |

* cited by examiner

*Primary Examiner*—Sophia S. Chen
(74) *Attorney, Agent, or Firm*—Fitzpatrick, Cella, Harper & Scinto

(57) ABSTRACT

A heating apparatus has an excitation coil; magnetic flux generator having a magnetic member core, the magnetic member core having a first magnetic core supported with a holder for the excitation coil and a rotatable second magnetic member core; an induction heat generating element for electromagnetic induction heat generation using the magnetic flux generated by the magnetic flux generator; a heating portion for receiving a recording material and for heating the recording material by the heat generated by the induction heat generating element; and a rotator for rotating second magnetic core to a different angular position to change a heat generation distribution in a longitudinal direction of the induction heat generating element.

8 Claims, 12 Drawing Sheets

FIG. 11 (1)
FIG. 11 (2)
FIG. 11 (3)
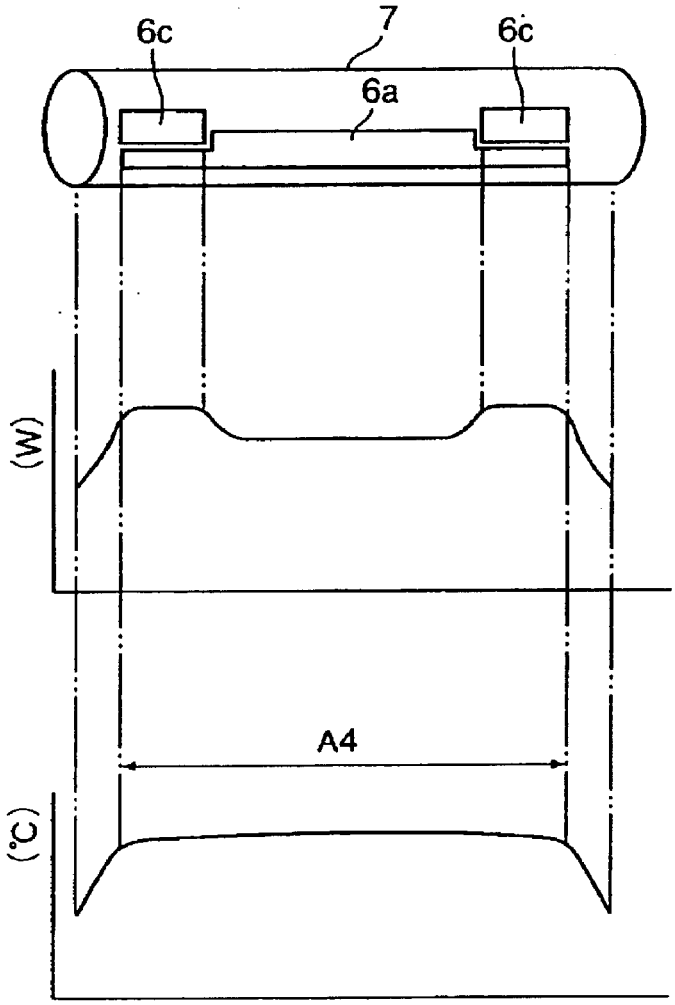

FIG. 12 (1)
FIG. 12 (2)
FIG. 12 (3)
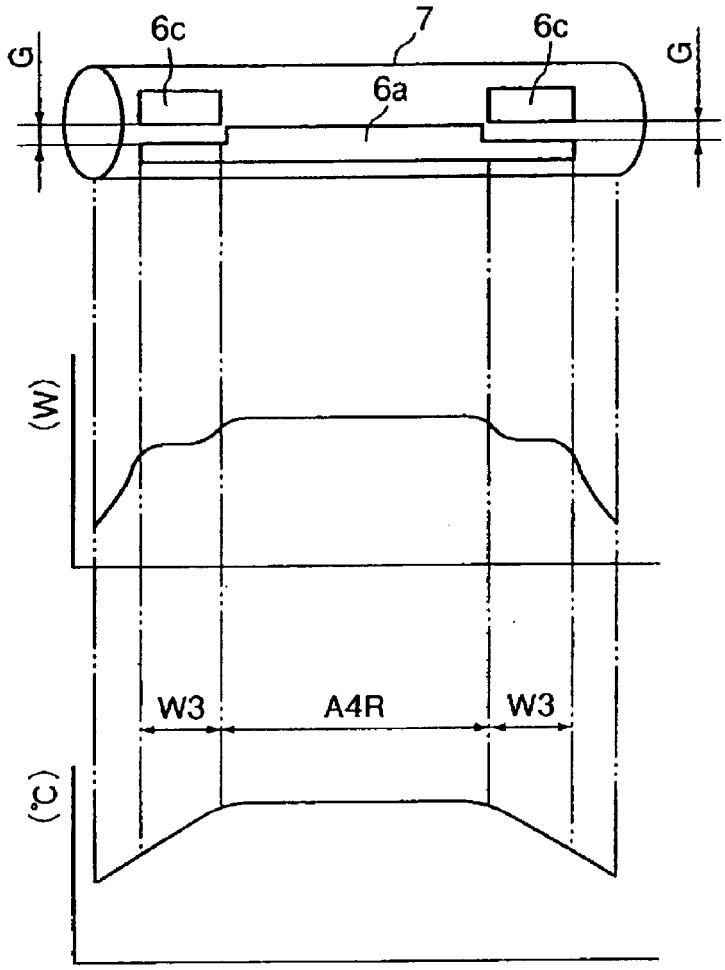

HEATING DEVICE AND IMAGE FORMING APPARATUS

FIELD OF THE INVENTION AND RELATED ART

The present invention relates to a heating apparatus of an electromagnetic (magnetic) induction heating type and an image forming apparatus comprising the same as an image heating means for image fixing or the like.

An image heat-fixing device in an image forming apparatus such as an electrophotographic copying machine, printer or facsimile machine will be taken as an example.

In the image forming apparatus, a toner (visualization material) of heat-fusing property resin material or the like is formed directly or indirectly (image transfer) on a recording material by image forming process means of an electrophotographic, electrostatic recording, magnetic flux recording type or the like in an image forming station of the image forming apparatus. The toner image thus formed is not yet fixed. It is fixed into a permanent fixed image by heat fixing process on the surface of the recording material.

As for such an image heat-fixing device, there are known a heating roller type, film heating type, electromagnetic induction heating type or the like.

a. Heating Roller Type

This comprises a fixing roller (heat roller) containing a heat source such as a halogen lamp and maintained at a predetermined fixing temperature and a pressing roller forming a nip with the fixing roller. The recording material carrying the unfixed toner image is passed through the nip (fixing nip), so that toner image is fixed on the recording material by heat.

However, the fixing roller has a large thermal capacity, and the electric power required for heating through roller is large, with the result that waiting time (the time from the main switch actuation to the printable state reached) is long. The thermal capacity of the fixing roller requires a great electric power to raise the temperature of the fixing nip.

As a countermeasurement, the thickness of the fixing roller is reduced so that thermal capacity of the fixing roller is reduced. However, doing so results in an insufficient mechanical strength. In addition, it involves a problem of temperature rise in a non-sheet-passage-part, similarly to the film fixing type which will be described hereinafter.

b. Film Heating Type

In this type of the device, a film is provided between a heating element and a recording material so that one side of the film is in sliding contact with a heating element, and the other side is in contact with the surface. The heat is applied from the heating element to the recording material through the film, by which the toner image is heated and fixed on the surface of the recording material, as disclosed in Japanese Laid-open Patent Application Sho 63-313172, Japanese Laid-open Patent Application Hei 2-157878, Japanese Laid-open Patent Application Hei 4-44075 to 4-44083, 4-204980 to 4-204984.

The heating element may be a low thermal capacity ceramic heater, and the film may be a heat resistive and low thermal capacity film, and therefore, the electric power can be significantly saved as compared with the heating roller type apparatus, and the waiting time reduction in addition accomplished (quick start property). In addition, the temperature rise in the apparatus is suppressed.

c. Electromagnetic induction heating type

This type uses an electromagnetic induction heat generation member, and a magnetic field is formed in the electromagnetic induction heat generation member by magnetic field generating means, by which eddy currents are generated in the electromagnetic induction heat generation member, and joule heat generation occurs. The heat thus produced is applied to the recording material (material to be heated), so that unfixed toner image is heat-fixed on the recording material.

Japanese Patent Application Publication Hei 5-9027 discloses an apparatus of a heating roller type using electromagnetic induction heating, in which the heat generation position is close to the nip, so that fixing process has a high efficiency then the apparatus of the heating roller type using the halogen lamp as a heat source.

However, since the thermal capacity of the fixing roller is large, the electric power consumption to raise the temperature of the fixing nip is still large. Reduction of the thermal capacity of the fixing roller is a solution of the problem. For example, the thickness of the fixing roller is reduced.

Japanese Laid-open Patent Application Hei 4-166966 discloses a fixing device of an electromagnetic induction heating type using a film-like fixing roller (film) as a fixing roller having a low thermal capacity.

However, in the film-like fixing roller, the heat flow is not good in the longitudinal direction of the fixing nip, with the result that when a small size recording material is passed through the nip, a problem of excessive temperature rise arises, the problem decreases the lifetime of the film and/or the pressing roller. The problem of the temperature rise at the non-sheet-passage-part also arises in the apparatus of the film heating type described in b.

Japanese Laid-open Patent Application Hei 9-171889 and Japanese Laid-open Patent Application Hei 10-74009 disclose a heating apparatus having a magnetic flux adjusting means by which a magnetic flux density distribution in the induction heat generating element provided by the generating means, in the longitudinal direction of the fixing roller (film). It is one of the solutions of preventing the temperature rise of the non-sheet-passage-part. The systems disclosed in Japanese Laid-open Patent Application Hei 9-171889 and Japanese Laid-open Patent Application Hei 10-74009 are very effective to prevent the heat generation in the non-sheet-passage-part, thus preventing the temperature rise of the non-sheet-passage-part. However, a shield plate for shielding the magnetic flux toward the fixing roller or the film from the coil and a mechanism for moving the shield plate are bulky.

In Japanese Laid-open Patent Application Hei 11-109774 and Japanese Laid-open Patent Application 2000-162913, the undesirable temperature rise in the non-sheet-passage-part is avoided by changing the gap between the magnetic member core and the induction heat generating element.

Another method for solving the problem of the temperature rise in the non-sheet-passage-part, the fixing speed is decreased when a small size recording material is passed. This method result in decreased throughput. By slowing down the fixing speed, the heat propagation toward the lateral ends ((non-sheet-passage-part) is promoted. However, the throughput of the image forming apparatus decreases.

In Japanese Laid-open Patent Application Hei 8-16005 and Japanese Laid-open Patent Application Hei 11-202652, the undesirable end temperature decrease is prevented by changing the disposition and the configuration of the magnetic member core depending on the longitudinal positions.

SUMMARY OF THE INVENTION

Accordingly, it is a principal object of the present invention to provide a heating apparatus and image forming apparatus in which an undesirable end temperature decrease and an undesirable temperature rise at non-sheet-passage-part.

Accordingly, it is a principal object of the present invention to provide a simple heating apparatus and a simple image forming apparatus in which the space saving, low cost, electric power saving are accomplished (compact), and a throughput is improved.

According to an aspect of the present invention, there is provided a heating apparatus includes an excitation coil; magnetic flux generating means having a magnetic member core, the magnetic member core including a first magnetic ends supported with a holder for the excitation coil and a rotatable second magnetic member core; an induction heat generating element for electromagnetic induction heat generation using the magnetic flux generated by the magnetic flux generating means; a heating portion for receiving a recording material and for heating the recording material by the heat generated by the induction heat generating element; and rotating means for rotating second magnetic core to a different angular position to change a heat generation distribution in a longitudinal direction of the induction heat generating element.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 11(1), 11(2) and 11(3) show a core arrangement, a heat generation distribution, and a surface temperature distribution of the fixing roller when the rotatable core supporting member takes the first angular position.

FIGS. 12(1), 12(2) and 12(3) show a core arrangement, a heat generation distribution, a surface temperature distribution of the fixing roller when the rotatable core supporting member takes the second angular position.

DESCRIPTION OF THE PREFERRED EMBODIMENTS (Embodiment 1)

(1) Example of Image Forming Apparatus

Figure 1:
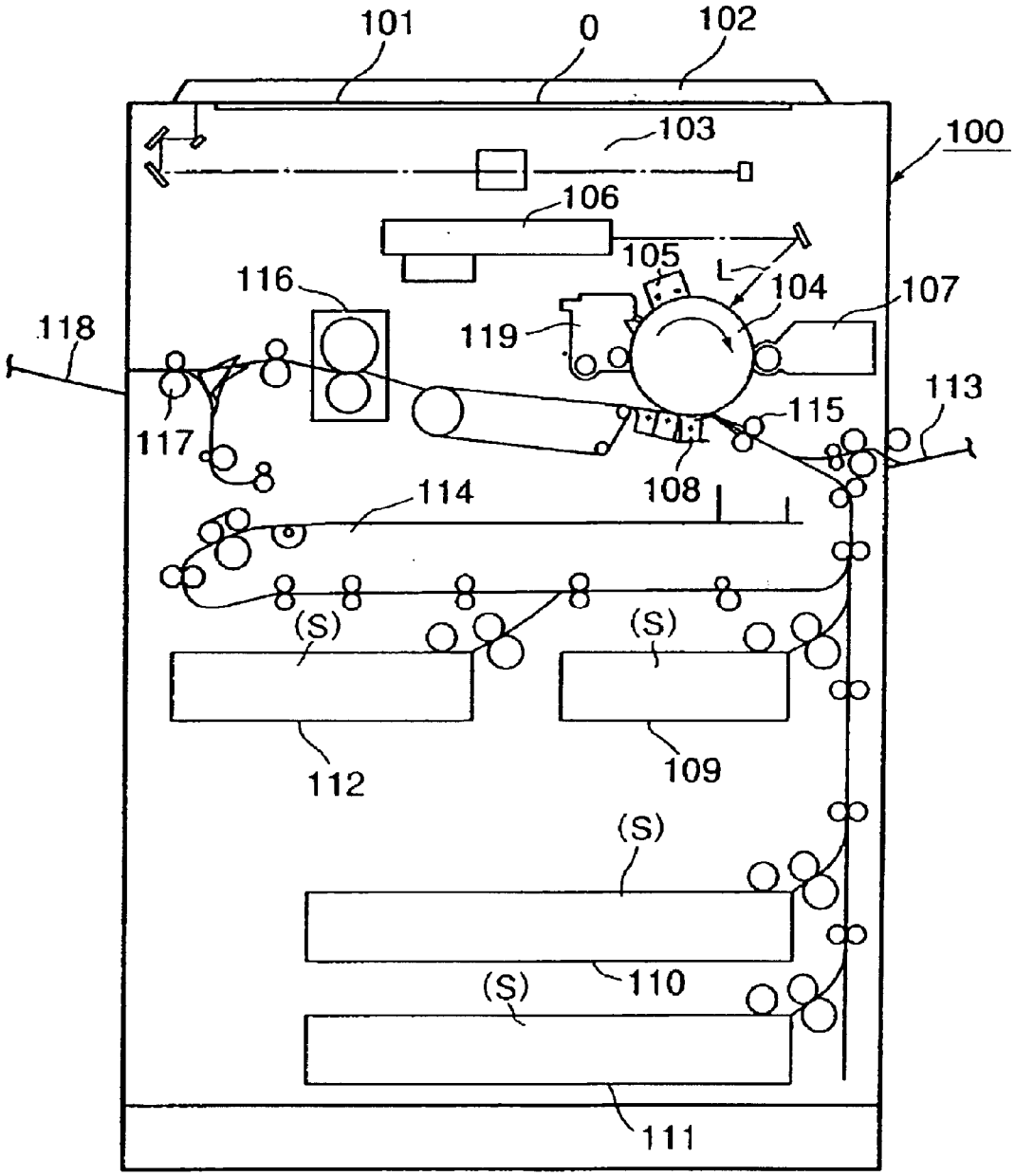
FIG. 1 in addition a schematic general arrangement of an image forming apparatus according to a first embodiment of the present invention.

FIG. 1 is a schematic general arrangement of an image forming apparatus 100 according to a first embodiment of the present invention. In this embodiment, the image forming apparatus 100 is a laser copying machine using an image transfer type electrophotographic process.

Designated by 101 is an original supporting platen glass, on which an original O is placed face down at a predetermined position, and is covered by an original cover 102. When a copy start key is depressed, an image photoelectric reading apparatus including a movement optical system (reader) 103 is operated, so that image information or the original O on the original supporting platen glass 101 is photo-electrically read. On the original supporting platen glass 101, an original automatic feeding apparatus (ADF, RDF) may be provided such that originals are automatically fed onto the original supporting platen glass 101.

Designated by 104 is an electrophotographic photosensitive member in the form of a rotatable drum, and is rotated in the clockwise direction indicated by an arrow at a predetermined peripheral speed. The peripheral surface of the photosensitive drum 104, during its rotation, is electrically charged by charging member 105 to a uniform potential of a predetermined polarity. The charged surface is exposed to image exposure light L from an image writing apparatus 106, by which the potential of the charged surface attenuates at the exposed portions, and an electrostatic latent image is formed corresponding to the exposure pattern on the surface of the photosensitive drum 104. In this embodiment, the image writing apparatus 106 is a laser scanner which emits a laser beam L modulated in accordance with an electric time-series digital signal indicative of the image information read by said photoelectric reading apparatus 103.

Subsequently, the electrostatic latent image is developed into a toner image by a developing device 107, and the toner image is electrostatically transferred from the surface of the photosensitive drum 104 onto a recording material S fed from a sheet feeding mechanism portion at predetermined timing to a transfer portion where a transfer charging device 108 is opposed to the photosensitive drum 104.

The sheet feeding mechanism portion, in this embodiment, has first, second, third and fourth cassettes 109–112, MP tray (multi-pass tray) 113, and a reverse refeeding portion 114, from which the recording material 5 is selectively fed to the transfer portion. Designated by 115 is a registration roller for adjusting the timing of the supply of the recording material to the transfer portion.

The recording material now having the toner image received from the surface of the photosensitive drum 104 at the transfer portion, is separated from the surface of the photosensitive drum 104, and is fed to a fixing device 116, where the toner image is fixed. Then, the recording material is discharged onto a sheet discharge tray 118 outside the apparatus by sheet discharging rollers 117.

On the other hand, the surface of the photosensitive drum 104 after the separation of the recording material, is cleaned by a cleaning device 119 so that deposited contamination such as residual toner or the like is removed, and the photosensitive drum 104 is prepared for the next image forming operation.

In the case of a duplex copy mode (both side copy or printing mode), the recording material already having the image on the first side and discharged from the fixing device 116, is introduced to the reverse refeeding portion 114 and is refed to the transfer portion, where the second toner image is transferred onto the second side of the recording material. The recording material is again fed to the fixing device 116 and is discharged onto the sheet discharge tray 118 by the sheet discharging rollers 117 as a duplex copy.

The copying machine in this embodiment is a combined function machine having a printer function and a facsimile machine function. However, these functions are omitted for simplicity of explanation of the present invention.

(2) Fixing Device 116

Figure 2:
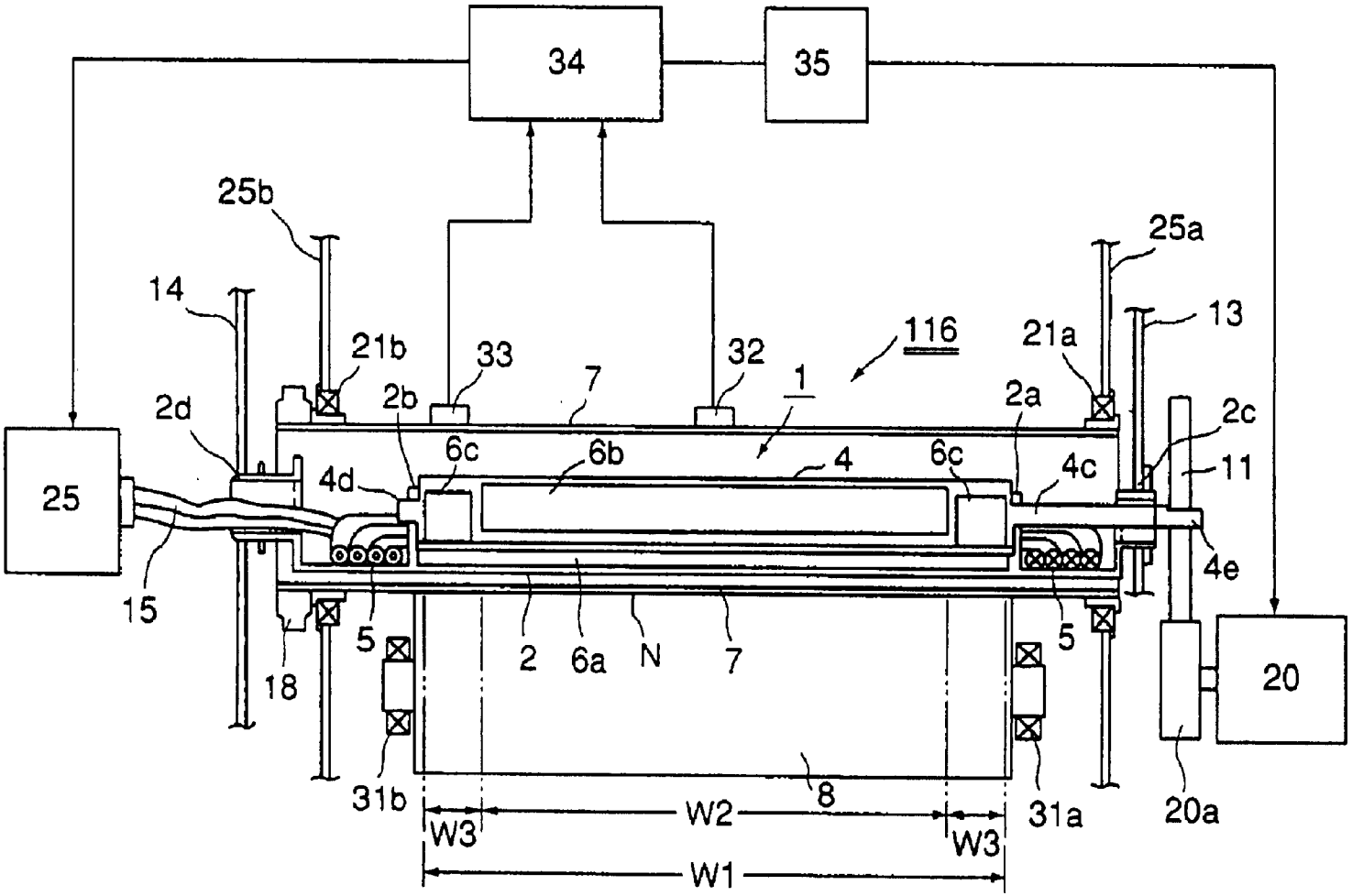
FIG. 2 is a longitudinal section schematic view of a fixing device (heating apparatus) of an electromagnetic induction heating type, wherein a rotatable core supporting member takes a first angular position.
Figure 3:
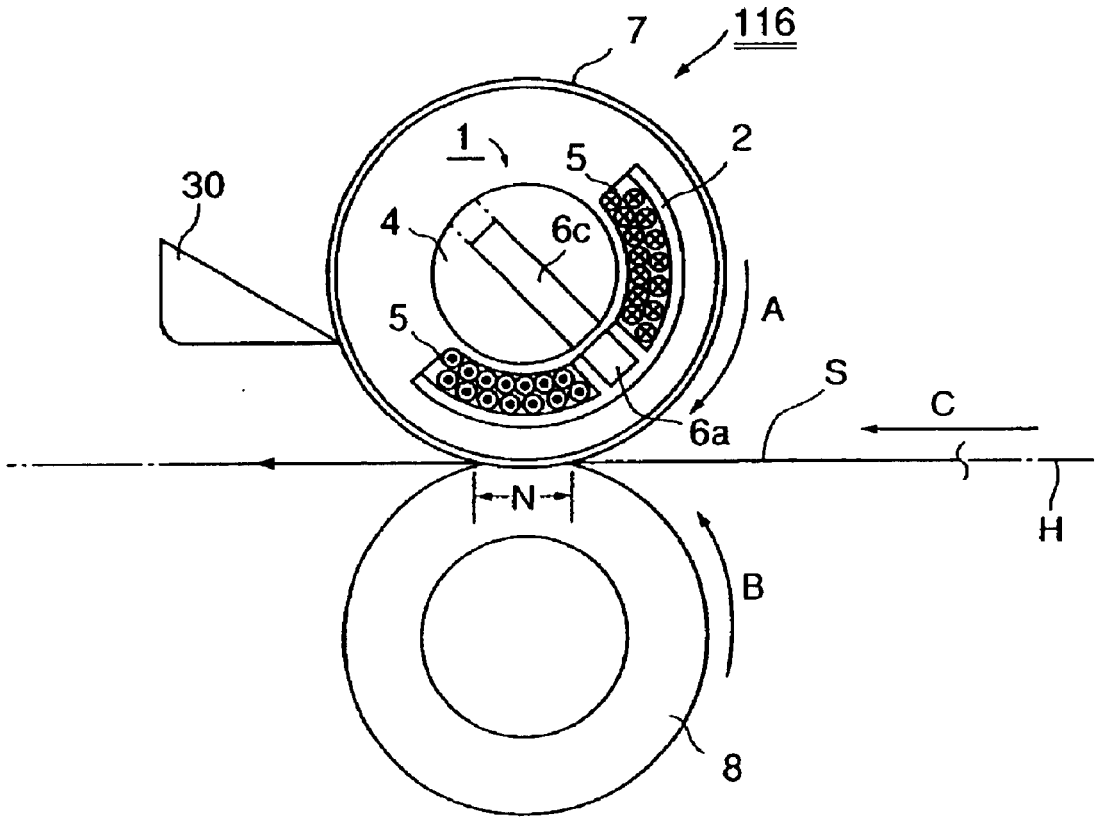
FIG. 3 is a longitudinal section schematic view of a fixing device (heating apparatus) of an electromagnetic induction heating type, wherein a rotatable core supporting member takes a first angular position.

FIG. 2 is a longitudinal section schematic view of a fixing device 116, and FIG. 3 is a cross-section thereof. The fixing device 116 is a heating apparatus of an electromagnetic induction heating type according to this embodiment of the present invention.

Designated by 7 is a cylindrical fixing roller functioning as an induction heat generating element which generates heat using electromagnetic induction and is rotatably supported between side plates 25*a* and 25*b* by bearings 21*a* end 21*b*. The fixing roller 7 is made of metal such as iron, nickel, cobalt or the like. The metal having ferromagnetic property (having a high magnetic permeability) is desirable since then the magnetic flux generated from the magnetic flux can be confined efficiently in the metal. That is, the magnetic flux density can be made high. By doing so, the eddy currents can be generated efficiently in the surface of the metal. The thickness of the fixing roller 7 is approx. 0.3–2 mm, and therefore, the thermal capacity is small. The outer surface of the fixing roller 7 is coated with an unshown toner parting layer. Generally, the coating is made of PTFE (10–50 $\mu$m) or PFA (10–50 $\mu$m). Inside of the toner parting layer, there is provided a rubber layer.

Designated by 1 is a heating assembly of a magnetic flux adjustment type disposed in the fixing roller 7, and comprises an excitation coil 5, magnetic member core 6*a*–6*c*, holder Z and a rotatable core supporting member 4. The structure of the heating assembly 1 will be described in detail in section (3).

Designated by 8 is an elastic pressing roller disposed in parallel with the fixing roller below the fixing roller 7, and is rotatably supported between the bearings 31*a* and 31*b*. It is press-contacted to the lower surface of the fixing roller 7 with a predetermined pressure against the elasticity of the fixing roller 7 by an unshown urging means, thus providing a fixing nip N (heating portion) having a predetermined width. The pressing roller 8 comprises a steel core, a silicone rubber layer thereon and a toner parting layer similarly to the fixing roller 7.

The fixing roller 7 has at one end a fixing roller gear 18 to which a rotating force is transmitted from an unshown driving system, and is rotated in the clockwise direction indicated by an arrow A in FIG. 3 at a predetermined peripheral speed. The pressing roller 8 is rotated by the rotation of the fixing roller 7 in the counterclockwise direction indicated by an arrow B.

The excitation coil 5 of the heating assembly 1 in the fixing roller 7 is supplied with electric power (high frequency current) from an electric power control apparatus (excitation circuit) 25 through a coil supply line 15, by which magnetic flux (alternating magnetic field) is generated from the heating assembly 1, and the fixing roller 7 (induction heat generating element) generates heat by inner (joule heat by eddy current loss). The temperature of the fixing roller 7 is detected by a first temperature detecting means (thermister or the like) 32, and the output thereof is supplied to the control circuit 34. The control circuit 34 controls the electric power supply to the excitation coil 5 of the heating assembly 1 from the electric power control apparatus 25 such that detected temperature of the fixing roller 7 supplied from a second temperature detecting means 32 is maintained at a predetermined fixing temperature, by which the temperature of he fixing roller is controlled.

When the fixing roller 7 and the pressing roller 8 are rotated, and the temperature of the fixing roller 7 is raised to the fixing temperature, the recording material S carrying the unfixed toner image transferred thereto is introduced into the fixing nip N of the fixing device 116 in the direction indicated by arrow C along the sheet feeding path H, as shown in FIG. 3. During the passing of the recording material S through the nip N, the unfixed toner image is fixed on the recording material S into a permanent fixed image by the heat and the nip pressure of the fixing roller 7 designated by 30 is a separation claw, and is introduced to the fixing nip N to prevent the recording material from winding around the fixing roller 7 after the fixing nip N and to separate it from the fixing roller 7.

The recording material S is fed into the fixing device 116 on the basis of a center reference, that is, the center of the width of the sheet is aligned with the center of the width of the heating device. In FIG. 2, W1 is a maximum width of recording materials S which are usable with the fixing device 116, W2 is a width of a small size recording material, and W3 and W3 are widths of non-sheet-passage-parts which result in the fixing nip N when the small size sheet of paper (sheet) having the width W2 is passed through the nip, and are the differences between the maximum size sheet width W1 and the small size sheet.

In the fixing device 116 of this embodiment, the width W1 of the maximum size sheet is the width of A4 size sheet (297 mm), and the width W2 of the small size sheet is the width of A4R (210 mm). In this embodiment, the maximum size sheet width W1 is the normal sheet width.

(3) Heating Assembly 1

The heating assembly 1 of the magnetic flux adjustment type in this embodiment, as a magnetic flux generating means having an excitation coil and a magnetic member core, comprises an excitation coil 5 (coil 5), first magnetic core 6*a* (first core 6*a*), a holder 2 supporting them, a second magnetic cores 6*b*, 6*c* (second cores 6*b*, 6*c*) and a rotatable core supporting member 4 for rotatably supporting said second magnetic core 6*b* and 6*c*.

The holder 2 has a trough like shape having a substantially semicircular cross-section, and has a substantially the same length as the fixing roller 7, and the inner surface thereof supports a first magnetic member core 6*a* (first core 6*a*) substantially at the central portion thereof along the length thereof. The length of the first core 6*a* is substantially the same as the normal sheet size width W1 and is positioned corresponding to the normal size sheet fed to the heating apparatus.

The excitation coil 5 (coil 5) is supported by the inner surface of the holder 2 concentrically with the first core 6*a*. The coil 5 is substantially elliptical in the longitudinal direction of the fixing roller 7 and follows in shape the inner surface of a cylindrical member such as the fixing roller 7. The coil 5 has a feature that it extends along the inner surface of the fixing roller 7 at the U-shaped turning portion. Because of this feature, a lead screw member 4 which will be described hereinafter can be disposed adjacent the coil 5. The coil 5 is disposed extending along the inner surface of the holder 2.

The rotatable core supporting member 4 is rotatably supported by bearing portions 2*a* and 2*b* at the shaft portions 4*c* and 4*d* at the opposite ends of the holder 2, and it has substantially the same length as the first core 6*a*, and is positioned above the first core 6*a* correspondingly to the first core 6*a*. The bearings 2*a*, 2*b* may be separate members of durable material.

The second cores 6*b* and 6*c* are bonded at a core set portion of the rotatable core supporting member 4 and is unified with the rotatable core supporting member 4 by snap engagement. They may be unified by resin material molding. The second cores 6*b* and 6*c* includes three cores, namely, the center core 6*b*, and end cores 6*c* and 6*c* at the opposite ends thereof, and the length of the center core 6*b* is substantially the same as the width W2 of the small size paper, and the position of the center core 6*b* corresponds to the position of the small size paper in the widthwise direction. The lengths of the end cores 6*c* and 6*c* are substantially the same as the widths W3 and W3 of the non-sheet-passage-part, and are positioned corresponding to the non-sheet-passage-part.

The total length of the second cores 6*b* and 6*c* is substantially the same as the length of the first core 6*a*, that is, the width W1 of the normal paper size, and are positioned corresponding to the normal paper size width.

In this manner, the heating assembly 1 is constituted by the holder 2, the first core 6*a*, the coil 5, the rotatable core supporting member 4 and the second cores 6*b* and 6*c*. The heating assembly 1 thus is constituted is securedly fixed and positioned on a supporting side plates 13 and 14 of the main assembly of the apparatus, by cylindrical arm 2*c* and 2*d* of the holder 2 at its opposite end portions.

The heating assembly 1 is out of contact with the inner surface of the fixing roller 7, and in the cross-section of FIG. 3, and is fixed on the fixing roller 7 such that first core 6*a* is disposed at a partly lower portion at an upstream side of the nip N with respect to the rotational direction of the fixing roller 7.

The shaft portion 4*c* of one side of the rotatable core supporting member 4 is extended out, and the extended portion 4*c* is extended out through the cylindrical arm portion 2*c* at one end and has a D-shaped cross-section, and is engaged with a gear 11 which is in meshing engagement with a drive gear 20*a* of a driving motor 20.

The control circuit 34 controls the driving motor 20 through the driver 35 to rotate the rotatable core supporting member 4 between first and second angular positions which are away from each other by 180°, as will be described hereinafter.

The coil 5 of the heating assembly 1 and the electric power control apparatus 25 are electrically connected through a coil supply line 15 in the cylindrical arm portion 2*d* at the other end of the holder.

By the first core 6*a* and the second cores 6*b* and 6*c*, a generally I-shaped core is formed, and a corresponding magnetic circuit is formed. The magnetic flux of the magnetic circuit extends from the first core 6*a* to the fixing roller 7, and from the upper portion of the fixing roller 7 extends into the second cores 6*b* and 6*c* and further to the first core 6*a*, thus establishing a magnetic circuit. Magnetic flux is alternating, and the magnetic flux also alternates in the magnetic circuit.

Figure 4:
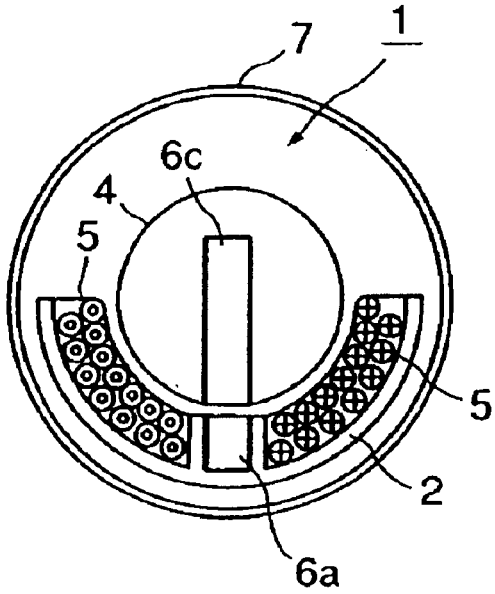
FIGS. 4(*a*) and 4(*b*) illustrates switching of the angular position of the rotatable core supporting member.
Figure 4:
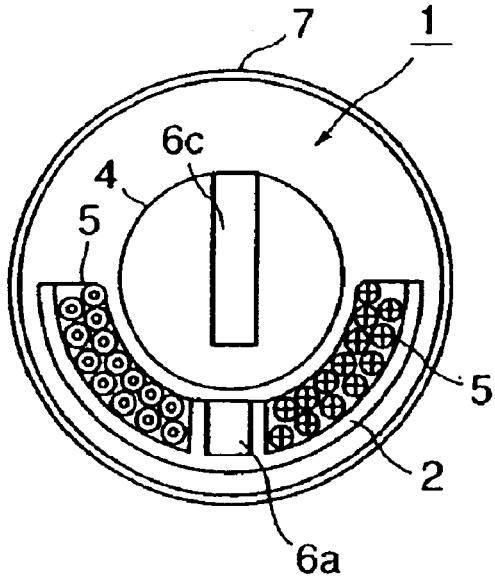

The second cores 6*b*, 6*c* in this embodiment is capable of taking two positions shown in FIG. 4, (a) and (b) (diametrically opposite) by the switching control for the rotatable core supporting member.

The position (a) is a first angular position of the rotatable core supporting member 4, and (b) is the second angular position of the rotatable core supporting member 4 which is diametrically opposite from the first angular position (180° away therefrom). Even if the angular position of the rotatable core supporting member 4 at which it is stopped is more or less deviated, the distributions. In the longitudinal direction, of the heat generation and of the fixing roller surface temperature are the same, although the heat generating efficiency is different.

Figure 5:
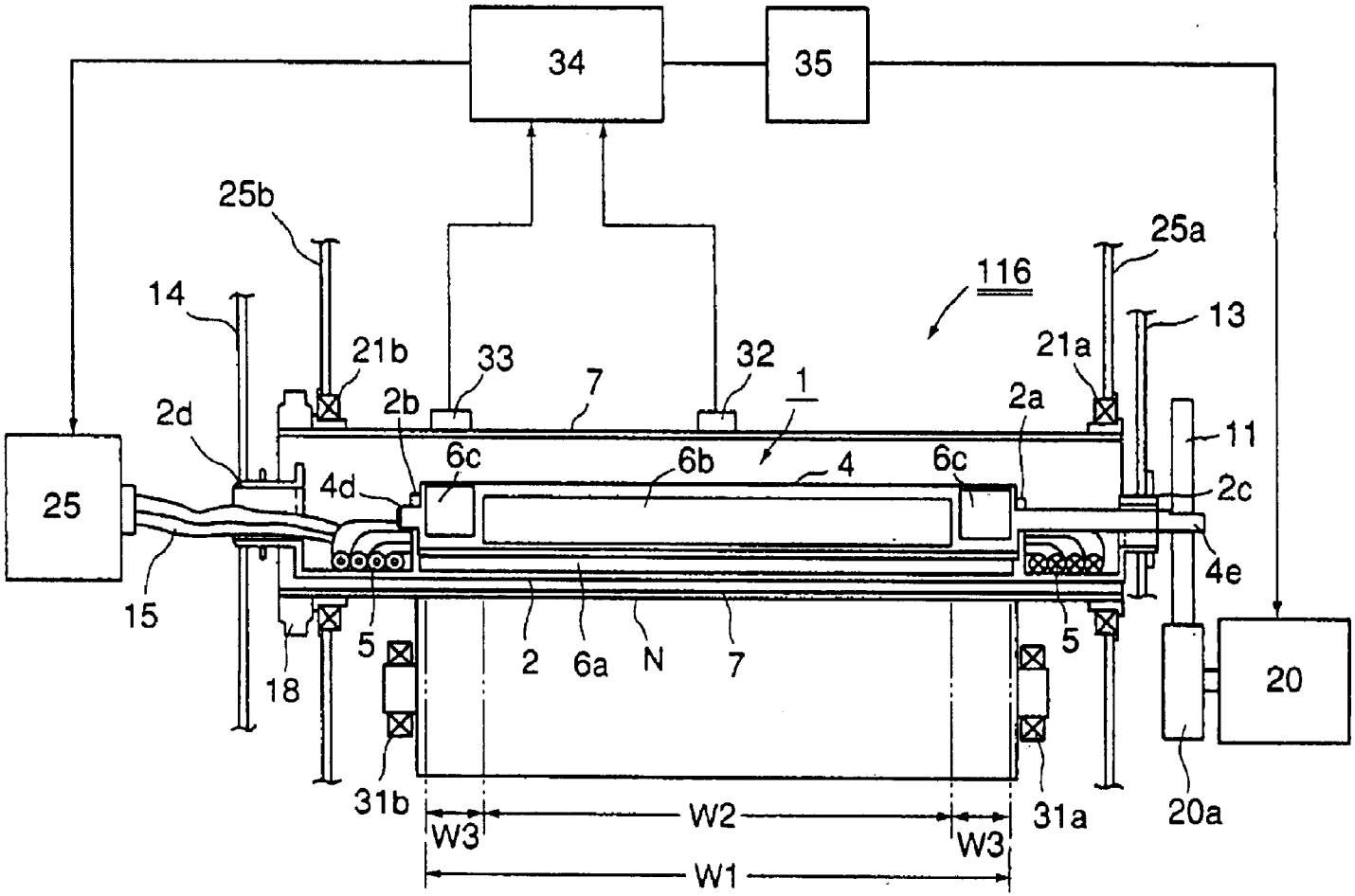

FIGS. 2 and 3 show the states in which the rotatable core supporting member 4 takes the first angular position, and FIG. 5 shows the state in which the rotatable core supporting member 4 takes the second angular position.

The description will be made as to the difference between the second core 6*b* and the second core 6*c*. The surface temperatures at the end portions of the fixing roller 7 is lower than the central portion of the fixing roller due to the heat transfer to the supporting member provided at the end portions. Therefore, the induction heat generation is made larger at the end portions of the fixing roller.

Figure 6:
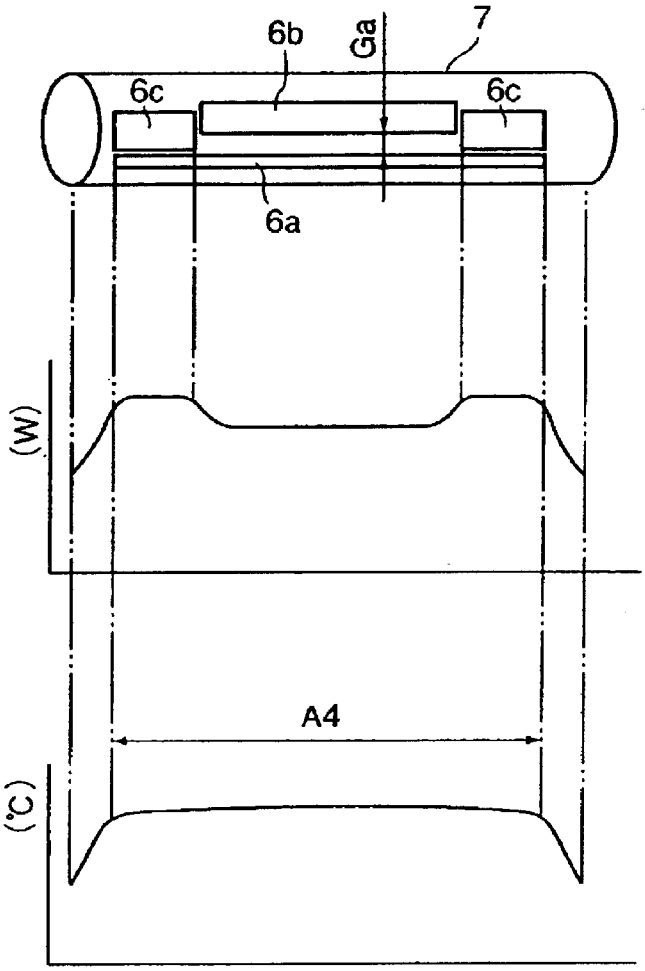
FIGS. 6(*a*), 6(*b*) and 6(*c*) show a core arrangement, a heat generation distribution, and a surface temperature distribution of the fixing roller when the rotatable core supporting member takes the first angular position.

(1) In this embodiment, by switching the rotatable core supporting member 4 to the first angular position, the second core 6*c* is made close to the first core 6*a* as shown in FIG. 6(1) with a gap Ga between the second core 6*b* at the central portion and the first core 6*a*. By doing so, the heat generation distribution is such that heat generation at the second core 6*c* (end) is larger, as sh won in FIG. 6(2). FIG. 6(3) shows the fixing roller surface temperature distribution which is uniform along the longitudinal direction. When a recording material S (A4) having the normal paper size width W1 is used, the rotatable core supporting member 4 is maintained at the first angular position.

(2) However, such supplemental at the end portions might adversely affect the prevention of the temperature rise at the non-sheet-passage-part.

Figure 7:
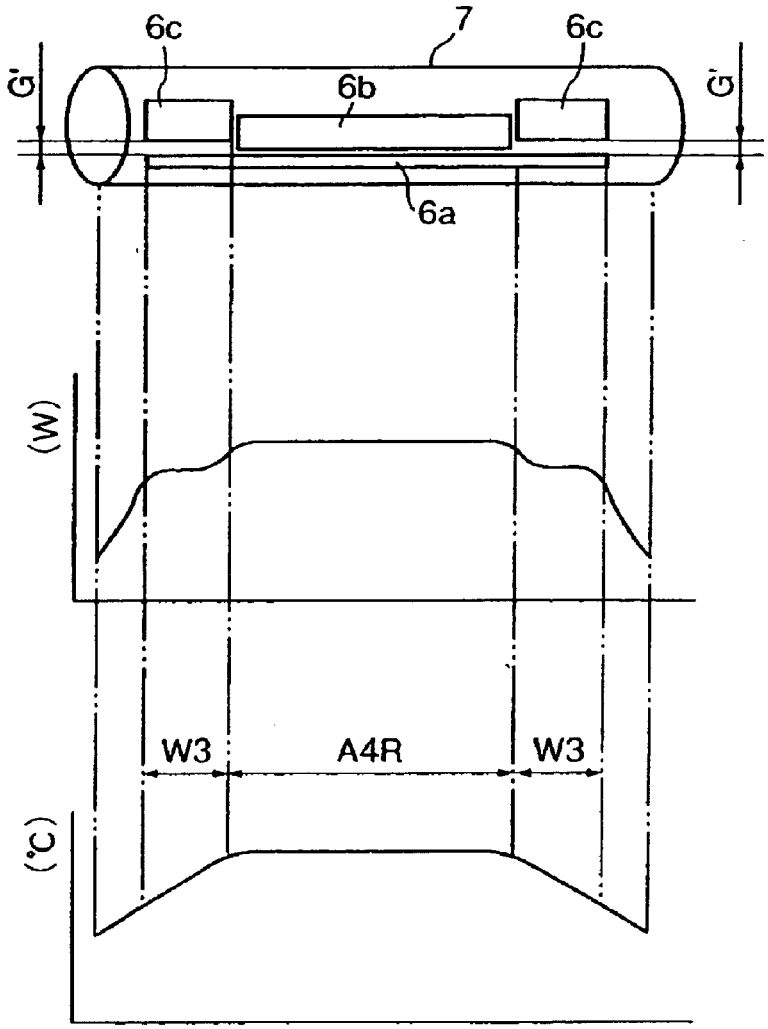
FIGS. 7(*a*), 7(*b*) and 7(*c*) show a core arrangement, a heat generation distribution, and a surface temperature distribution of the fixing roller when the rotatable core supporting member takes the second angular position.

FIG. 7 shows a core arrangement, a heat generation distribution and a surface temperature of the fixing roller when the countermeasurement is taken against the temperature rise at the non-sheet-passage-part. When the recording material S (A4R) having a small size paper width W2, with which the temperature rise at the non-sheet-passage-part may occur, is used, the rotatable core supporting member 4 is maintained at the second angular position which is 180° away from the first angular position.

This is shown in FIG. 6(1). In FIG. 7, the gap G' between the first core 6*a* and the second core 6*c* is large, so that heat generation of the fixing roller 7 at the position corresponding to the second core 6*c*, and therefore, the temperature lowers. In this manner, the countermeasurement against the undesirable end temperature falling of the fixing roller 7 and the countermeasurement against the undesirable temperature rise at the non-sheet-passage-part, both effectively function.

When the recording material S having the normal paper size width W1 (A4) with which no temperature rise occurs at the non-sheet-passage-part, is used, the image fixing is possible over the entire width of the sheet. When the recording material S (A4R) having the small size paper width W2 with which the undesirable temperature rise occurs at the non-sheet-passage-part, is used, the heat generation by the electromagnetic induction is reduced in the range of the non-sheet-passage-parts W3 and W3, so that non-sheet-passage-part temperature rise can be suppressed.

The rotatable core supporting member 4 is normally takes the first angular position for the recording material S (A4) having the normal paper size width W1 with which no temperature rise occurs at the non-sheet-passage-part (FIGS. 2, 3, 6).

When the recording material S having the small size paper (A4R) width W2 with which the temperature rise occurs at the non-sheet-passage-part, is used, the rotatable core supporting member 4 is rotated to the second angular position as shown in FIG. 5 and FIG. 7.

The switching between the first and the second angular positions of the rotatable core supporting member 4, is automatically effected by the control circuit 34 depending on the image to be formed, or is determined by the control circuit 34 depending on the sheet size set by the designation of the user. When the size of the used sheet is the one which will result in the temperature rise is the non-sheet-passage-part, the rotatable core supporting member 4 is rotated to the second angular position to prevent the temperature rise of the non-sheet-passage-part in the non-sheet-passage-part.

In the case that plurality of detecting means for detecting surface temperatures of the fixing roller at a plurality of positions in an image forming apparatus, the rotatable core supporting member 4 may be operated in accordance with the outputs of the plurality of detecting means. More particularly, as shown in FIGS. 2 and 5, a first temperature detecting means 32 and a second temperature detecting means 33 are provided, the second temperature detecting means 33 disposed in the position corresponding o the non-sheet-passage-part. In such an example, the rotatable core supporting member 4 way be rotated to the second angular position depending on the output of the second temperature detecting means 33. The first temperature detecting means 32 is disposed at a position corresponding to the small size sheet width range.

The present invention does not limit the operation sequence of the magnetic flux shield members 3*a* and 3*b* to a particular one.

When the width of the used sheet is smaller than the normal width W1, and is larger than the smaller size width W2 (so called A4R sheet), that is, when the used sheet is (B4, small size sheet), the rotatable core supporting member 4 is frequently rotated to make the surface temperature uniform along the longitudinal direction of the fixing roller.

The material of the rotatable core supporting member 4 and the holder 2 may preferably be PPS resin material, PEEK resin material, polyamide resin material, polyamide resin material, polyamide-imide resin material, ceramic, liquid crystal polymer, fluorine resin material or the like which has heat resistive property and mechanical strength. Furthermore, the material may be added with glass.

If the rotatable core supporting member 4 and the holder in the heating assembly 1 is of magnetic material, the rotatable core supporting member and the holder generate heat by the electromagnetic induction with the result that heat generating efficiency of the fixing roller decreases. When a metal other than the resin material is used, the reduction of the heat generating efficiency may be minimized by using non-magnetic material having a high electroconductivity.

The coil 5 is required to generate alternating magnetic flux sufficient to the heating. It is desirable that resistance component is low, and the inductance component is high. The wire of the coil may be Litz wire comprising a bundle of 80–160 fine wires having a diameter of 0.1–0.3 mm. The fine wires may be insulation coating electric wires. In the coil 5, the wire is wound 8–12 times around the first core 6*a*.

The core 6*a*, 6*b* and 6*c* are preferably made of ferrite, permalloy or the like which has a high magnetic permeability and low remanent magnetic flux density, but it may be any if it can generate the magnetic flux.

The present invention is not limited to a particular configuration or configuration of the coil 5, the core 6*a*, 6*b* and 6*c*, the induction heat generating element.

As described in the foregoing, by rotating the rotatable core supporting member 4, the temperature decrease at the end portion and the temperature rise at the non-sheet-passage-part can both be suppressed.

It is known that closer the distance between the coil 5 and the induction heat generating element (fixing roller 7), the better the heat generating efficiency is. The heat generating efficiency is better than the system using a magnetic flux shield member.

(Embodiment 2)

FIGS. 8–12 illustrates a second embodiment. The same reference numerals as with the first embodiment are assigned to the elements having the corresponding functions.

In this embodiment, the function of the second core 6*b* in the first embodiment is assigned to the first core 6*a*, by which the second core supported by the rotatable core supporting member 4 is provided only at the opposite end portions (cores 6*c* and 6*c*).

The space occupied by the core of the magnetic flux generating means is small, and from the standpoint of the heat generating efficiency, this embodiment is inferior to the first embodiment, but the core member is simplified, and the cost can be reduced.

Figure 8:
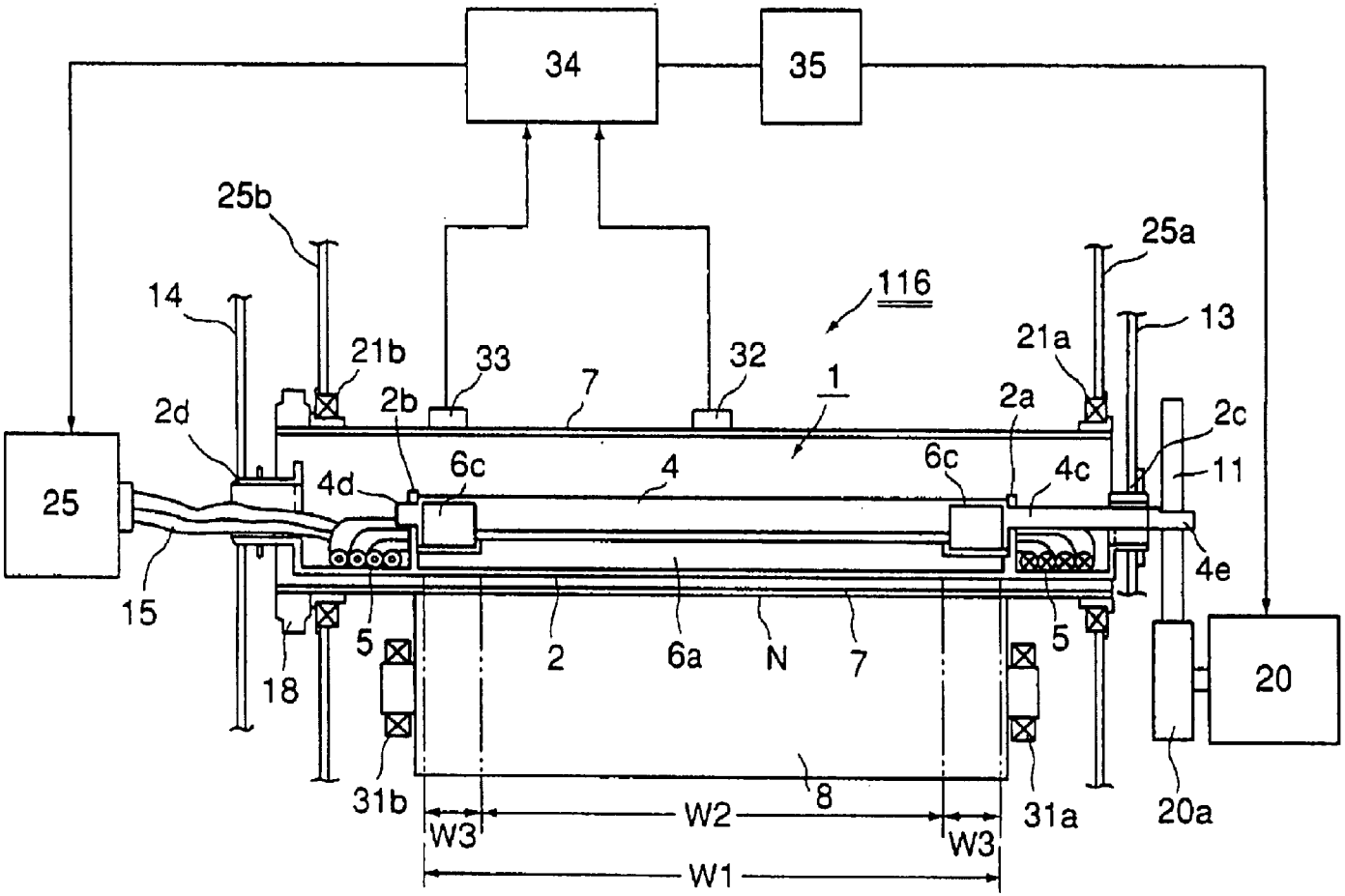
FIG. 8 is a longitudinal section schematic view of a fixing device (heating apparatus) of an electromagnetic induction heating type, wherein a rotatable core supporting member takes a first angular position), according to a second embodiment of the present invention.
Figure 9:
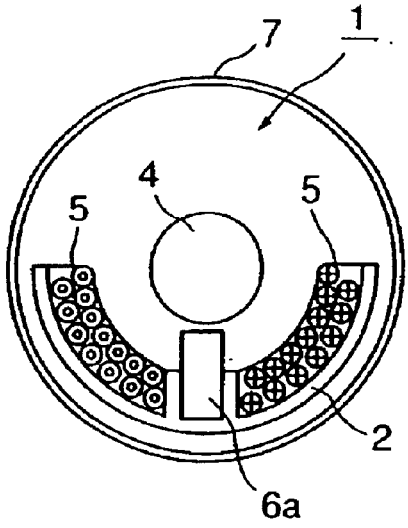
FIGS. 9(*a*), 9(*b*) and 9(*c*) illustrate switching of the angular position of the rotatable core supporting member.
Figure 9:
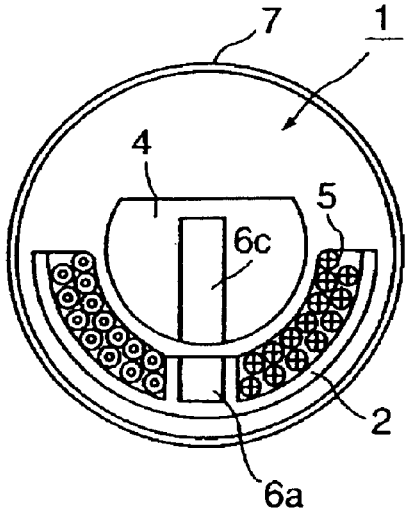
Figure 9:
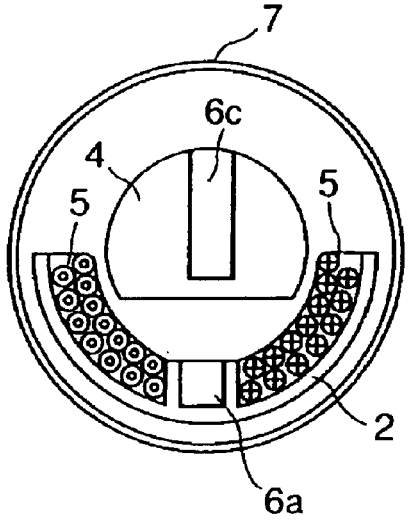

(1) FIG. 8 deals with the case in which the recording material S (A4) having the normal paper size width W1 with which the undesirable temperature rise does not occur at the non-sheet-passage-part, is used, and the rotatable core supporting member 4 takes the first angular position. FIG. 9(*b*) is a sectional view of the second core 6*c* in such a case. The heat generation distribution along the length of the fixing roller in this state is set such that it is high at the end portions, as shown in FIG. 11(2), by which the heat generation offsets the end temperature decrease. As a result, the surface temperature is a fixing roller as shown in FIG. 11(3).

Figure 10:
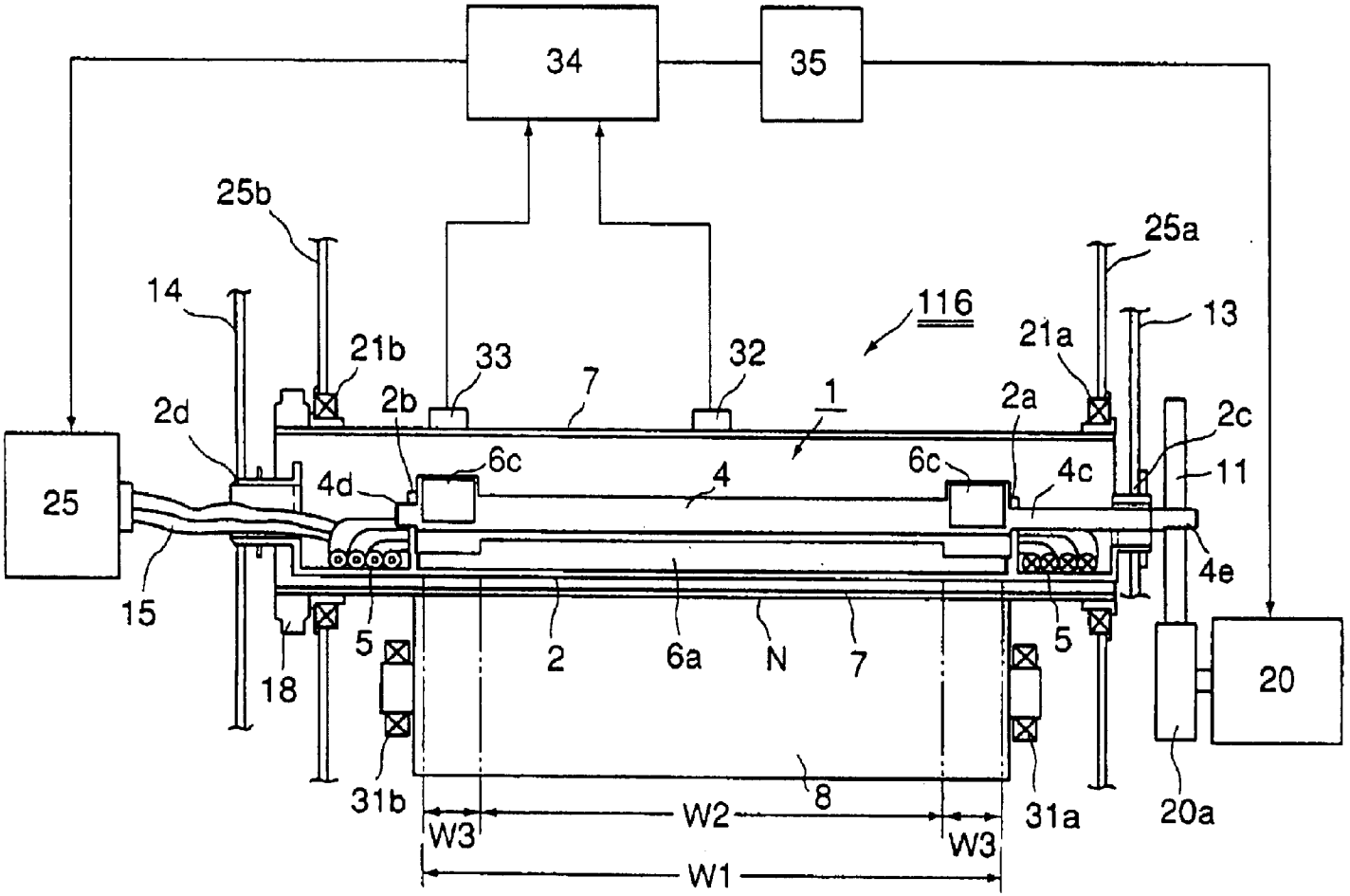
FIG. 10 is a longitudinal section schematic view of a fixing device (heating apparatus) of an electromagnetic induction heating type, wherein a rotatable core supporting member takes a second angular position).

(2) When the recording material S (A4R) having the small size paper width W2 with which the undesirable temperature rise occurs at the non-sheet-passage-part, is used, the rotatable core supporting member 4 is switched to the second angular position which is 180° away from the first angular position. FIG. 10 shows the state in which the rotatable core supporting member 4 has been rotated so that second core 6*c* has been moved. FIG. 9(*c*) is a sectional view of the second core 6*c* in such a case. The gap G between the second core 6*c* and the first core 6*a* expands as shown in FIG. 12(1), and therefore, the heat generation of the fixing roller portion corresponding to the second core 6*c* is suppressed as shown in FIG. 12(2). By th is, the temperature at the fixing nip N in the range of the non-sheet-passage-part W3 is as shown in FIG. 12(3), so that undesirable temperature rise in the non-sheet-passage-part can be suppressed.

The section of the central portion in the longitudinal direction of the fixing roller does not change in FIG. 9(*a*) by the rotation of the rotatable core supporting member 4.

Similarly to the first embodiment, by controlling the angular position of the rotatable core supporting member 4, the temperature rise in the non-sheet-passage-part and the end temperature decrease can both be suppressed.

(Others)

1) the configurations of the first core and the second core are not limited to the rectangular shape, but may include an inclined portion, or may be provided by a plurality of cores. The length of the core may be set to correspond to the paper size of the frequently used sheets. The latitude in the design of the core configuration and disposition expands so as to be usable with a wide range of the fixing devices. The advantageous effects or the present invention are maintained when a fixing film is used in place of the fixing roller. The present invention may be used in consideration of the specifications, arrangement of the fixing device of the image forming apparatus with which the heating device is used.

2) the sheet may be fed with one lateral side aligned with one longitudinal end of the heating device, in which case the heating apparatus is properly constructed corresponding to the system.

3) the applicability of the heating apparatus of the electromagnetic induction heating type and magnetic flux adjustment type is not limited to the image heat-fixing device, but is possible with respect to an image heating device by which the image carrying recording material is heated to improve the surface property such as glossiness or the like, an image heating device for temporary fixing processing, a drying process by which the sheet-like material is dried by passing it through the heating device, a heating device for laminating a sheet-like material, a dry fixing device usable with an ink jet printer or the like, for example.

As described in the foregoing, according to the present invention, there is provided a heating apparatus of an electromagnetic induction heating type having a rotatable second magnetic core which is rotated by rotating means in accordance with the size of the recording material, by which the undesirable temperature decrease at the end portions and the undesirable temperature rise at the end portions can both be effectively avoided.

According to this invention, there is not space required for placing the retraced magnetic flux shield member, so that the space saving can be accomplished, and the main assembly of the image forming apparatus can be downsized.

In a conventional structure in which the magnetic flux shield member is rotated, the magnetic flux shield member may be contacted to the coil, but in the present invention, the contact between the coil and the magnetic flux shield member can be avoided.

In a conventional structure in which the sheet is fed through the fixing device along the center thereof (center portion reference feeding system), the spaces are required at both of the opposite longitudinal end portions of the fixing device, for the magnetic flux shield member placed at the non-operative (retracted) position and for the driving means for the magnetic flux shield member. According to the present invention, the magnetic flux shield member is kept in the fixing roller, and the driving means can be disposed at one end longitudinal end portion only, so that space saving is accomplished, and the main assembly of the image forming apparatus can be downsized.

According to the present invention, the problem of the temperature rise in the non-sheet-passage-part can be solved without slowing down the fixing speed, and therefore, the printing or copying throughput can be improved.

The magnetic flux generating means (coil and core), the holder, the rotatable core supporting member are constituted into one assembly, so that assembling property and the servicing property can be improved.

According to the present invention, the space saving can be accomplished, the cost thereof is reduced, the electric power saving is accomplished, and the throughput is improved in the induction heating type heating apparatus.

While the invention has been described with reference to the structures disclosed herein, it is not confined to the details set forth and this application is intended to cover such modifications or changes as may come within the purpose of the is improvements or the scope of the following claims.

What is claimed is:

1. A heating apparatus comprising:

a coil for generating a magnetic flux;

a heat generating member for generating heat using the magnetic flux generated by said coil, said heat generating member being effective to heat a material to be heated;

a first magnetic member, located at a fixed position adjacent said coil, for inducing the generated magnetic flux to said heat generating member;

a second magnetic member for inducing the generated magnetic flux to said heat generating member, said second magnetic member being disposed opposed to said heat generating member with said first magnetic member interposed therebetween; and moving means for moving said second magnetic member relative to said first magnetic member, wherein said first magnetic member has a length corresponding to the material to be heated having a maximum length measured in the widthwise direction, and said second magnetic member is disposed opposed to a longitudinal end of said first magnetic member and has a length shorter than that of said first magnetic member, wherein when the material to be heated has a length measured in the widthwise direction which is smaller than the maximum length, said moving means moves said second magnetic member away from said first magnetic member.

2. An apparatus according to claim 1, wherein said moving means is a rotational moving means for rotating said second magnetic member.

3. An apparatus according to claim 2, wherein said moving means has a drive transmission member for transmitting a rotational driving force to the second magnetic member, said drive transmission member is rotatably supported on a supporting member for supporting said coil, and forms an assembly integrally assembled with said coil.

4. An apparatus according to claim 2, wherein said second magnetic member is disposed eccentrically with respect to a rotational axis of said rotational moving means, and positions, relative to the rotational axis, of said second magnetic member at a longitudinal end portion and central portion of said heat generating element extending in a direction crossing with a feeding direction of the material to be heated, are different from each other, and wherein amounts of the generated heat at the end and central positions are made different from each other by rotating said second magnetic member.

5. A fixing apparatus comprising:

a coil for generating magnetic flux;

a heat generating member for generating heat using the magnetic flux generated by said coil, said heat generating member being effective to heat and fix a toner image on a material to be heated;

a first magnetic member, located at a fixed position adjacent said coil, for inducing the generated magnetic flux to said heat generating member, a second magnetic member for inducing the generated magnetic flux to said heat generating member, said second magnetic member being disposed opposed to said heat generating member with said first magnetic member interposed therebetween; and moving means for moving said second magnetic member relative to said first magnetic member in accordance with a length of material to be heated measured in a widthwise direction.

6. An apparatus according to claim 5, wherein said first magnetic member has a length corresponding to the material to be heated having a maximum length measured in the widthwise direction, and said second magnetic member is disposed opposed to a longitudinal end of said first magnetic member and has a length shorter than that of said first magnetic member, wherein when the material to be heated has a length measured in the widthwise direction which is smaller than the maximum length, said moving means moves said second magnetic member away from said first magnetic member.

7. An apparatus according to claim 5, wherein said moving means moves said second magnetic member so as to change a gap between said second magnetic member and said first magnetic member.

8. A heating apparatus comprising:

a coil for generating a magnetic flux;

a heat generating member for generating heat using the magnetic flux generated by said coil, said heat generating member being effective to heat a material to be heated;

a first magnetic member, located at a fixed position adjacent said coil, for inducing the generated magnetic flux to said heat generating member;

a second magnetic member for inducing the generated magnetic flux to said heat generating member, said second magnetic member being disposed opposed to said heat generating member with said first magnetic member interposed therebetween; and moving means for moving said second magnetic member relative to said first magnetic member, wherein said first magnetic member has a length corresponding to the material to be heated having a maximum length measured in the widthwise direction, and said second magnetic member is disposed opposed to a longitudinally central portion of said first magnetic member and has a length shorter than that of said first magnetic member, and wherein when the material to be heated has a length measured in the widthwise direction which is smaller than the maximum length, said moving means moves said second magnetic member toward said first magnetic member.

* * * * *

UNITED STATES PATENT AND TRADEMARK OFFICE

CERTIFICATE OF CORRECTION

PATENT NO. : 6,954,608 B2
DATED : October 11, 2005
INVENTOR(S) : Hajime Sekiguchi et al.

It is certified that error appears in the above-identified patent and that said Letters Patent is hereby corrected as shown below:

Column 2,
Line 10, “high” should read -- higher --.
Line 11, “then” should read -- than --.
Line 54, “result” should read -- results --.

Column 3,
Line 10, “includes” should read -- including --.
Line 13, “ends” should read -- core --.
Line 42, “illustrates” should read -- illustrate --.

Column 5,
Line 40, “holder Z” should read -- holder 2 --.

Column 7,
Line 12, “includes” should read -- include --.
Line 28, “is” (1st occurrence) should be deleted.
Line 62, “is” should read -- are --.

Column 8,
Line 4, “distributions. In” should read -- distributions, in --.
Line 14, “is” should read -- are --.
Line 25, “sh won” should read -- shown --.
Line 31, “supplemental” should read -- supplementation --.
Line 61, “is” should be deleted.

Column 9,
Line 14, “that” should read -- of --.
Line 22, “o” should read -- to --.
Line 24, “way” should read -- may --.
Lines 61 and 66, “core” should read -- cores --.

Column 10,
Line 11, “illustrates” should read -- illustrate --.
Line 48, “th is,” should read -- this, --.

UNITED STATES PATENT AND TRADEMARK OFFICE

CERTIFICATE OF CORRECTION

PATENT NO. : 6,954,608 B2
DATED : October 11, 2005
INVENTOR(S) : Hajime Sekiguchi et al.

It is certified that error appears in the above-identified patent and that said Letters Patent is hereby corrected as shown below:

Column 11,
Line 47, "end" (1st occurrence) should be deleted.
Line 67, "is" should be deleted.

Signed and Sealed this

Twenty-first Day of March, 2006

JON W. DUDAS
*Director of the United States Patent and Trademark Office*